US010571942B2

(12) United States Patent
Tomioka

(10) Patent No.: US 10,571,942 B2
(45) Date of Patent: Feb. 25, 2020

(54) OVERCURRENT LIMITING CIRCUIT, OVERCURRENT LIMITING METHOD, AND POWER SUPPLY CIRCUIT

(71) Applicant: ABLIC Inc., Chiba-shi, Chiba (JP)

(72) Inventor: Tsutomu Tomioka, Chiba (JP)

(73) Assignee: ABLIC INC., Chiba (JP)

( * ) Notice: Subject to any disclaimer, the term of this patent is extended or adjusted under 35 U.S.C. 154(b) by 0 days.

(21) Appl. No.: 16/240,410

(22) Filed: Jan. 4, 2019

(65) Prior Publication Data

US 2019/0243400 A1 Aug. 8, 2019

(30) Foreign Application Priority Data

Feb. 5, 2018 (JP) ..... 2018-018423

(51) Int. Cl.
*G05F 1/573* (2006.01)
*G05F 1/575* (2006.01)

(52) U.S. Cl.
CPC ..... *G05F 1/573* (2013.01); *G05F 1/575* (2013.01)

(58) Field of Classification Search
CPC ..... G05F 1/573; G05F 1/5735; G05F 1/575
USPC ..... 361/93.9; 323/276
See application file for complete search history.

(56) References Cited

U.S. PATENT DOCUMENTS 7,644,663 B2 * 1/2010 Illesi ..... F42B 8/16 102/498
2003/0122530 A1 * 7/2003 Hikita ..... G05F 1/573 323/285
2003/0128489 A1 * 7/2003 Katoh ..... G05F 1/575 361/93.9
2005/0007189 A1 * 1/2005 Bo ..... G05F 1/573 327/541
2006/0133000 A1 * 6/2006 Kimura ..... G05F 1/5735 361/93.1
2006/0250740 A1 * 11/2006 Itoh ..... G05F 1/5735 361/93.1
2007/0206338 A1 * 9/2007 Ishino ..... G05F 1/575 361/93.9
2008/0278127 A1 * 11/2008 Nagata ..... G05F 1/56 323/276
2008/0285198 A1 * 11/2008 Morino ..... G05F 1/573 361/93.9

(Continued)

FOREIGN PATENT DOCUMENTS

JP 2009-48362 A 3/2009

*Primary Examiner* — Gary L Laxton
*Assistant Examiner* — Sisay G Tiku
(74) *Attorney, Agent, or Firm* — Brinks, Gilson & Lione

(57) ABSTRACT

The overcurrent limiting circuit includes: a limit voltage generation circuit generating a limit voltage which defines the limit current value as a current corresponding to a magnitude of a power supply voltage; a source follower having an output terminal and an input terminal which is connected to a gate of the output stage transistor, and configured to supply from the output terminal a voltage level-shifted from a voltage provided to the input terminal; an error amplifier circuit amplifying a difference between the limit voltage and the voltage supplied from the source follower; and a gate voltage adjustment transistor having a gate to which the voltage supplied from the error amplifier circuit is applied, and controlling a gate voltage applied to the gate of the output stage transistor.

11 Claims, 10 Drawing Sheets

(56) References Cited

U.S. PATENT DOCUMENTS

| | | | | |
|---|---|---|---|---|
| 2009/0046404 | A1* | 2/2009 | Morino | G05F 1/573 361/93.9 |
| 2009/0180231 | A1* | 7/2009 | Tanaka | G05F 1/573 361/93.9 |
| 2012/0169303 | A1* | 7/2012 | Chen | G05F 1/573 323/265 |
| 2012/0286751 | A1* | 11/2012 | Sakaguchi | G05F 1/573 323/282 |
| 2013/0193939 | A1* | 8/2013 | Sakaguchi | H02H 9/02 323/277 |
| 2014/0184182 | A1* | 7/2014 | Yajima | G05F 1/575 323/273 |

* cited by examiner

RELATED ART

OVERCURRENT LIMITING CIRCUIT, OVERCURRENT LIMITING METHOD, AND POWER SUPPLY CIRCUIT

RELATED APPLICATIONS

This application claims priority under 35 U.S.C. § 119 to Japanese Patent Application No. 2018-018423 filed on Feb. 5, 2018, the entire content of which is hereby incorporated by reference.

BACKGROUND OF THE INVENTION

1. Field of the Invention

The present invention relates to an overcurrent limiting circuit, an overcurrent limiting method, and a power supply circuit.

2. Description of the Related Art

A constant-voltage power supply circuit supplies a constant voltage stably even when an output current changes due to a load fluctuation or the like.

However, when the load fluctuation is large and a current flows beyond the rated value, e.g., in a case of occurrence of a ground fault, etc., there is a need to prevent damage to the transistor at an output stage (hereinafter output stage transistor) of the power supply caused by heat which is generated by an overcurrent.

The constant-voltage power supply circuit is thus required to have an overcurrent limiting circuit which limits the maximum output current so as not to exceed an upper limiting value defined as the rated value (refer to, for example, Japanese Patent Application Laid-Open No. 2009-48362).

In Japanese Patent Application Laid-Open No. 2009-48362, there is provided an overcurrent limiting circuit illustrated in FIG. 8 which suppresses lowering of a gate voltage V1 of an output stage transistor 105 upon grounding of an output terminal 102 to thereby limit an overcurrent flowing through the output stage transistor 105. Adjusting a limit voltage V3 limiting the overcurrent flowing through the output stage transistor 105, based on an output voltage Vout or a feedback voltage VFB, the overcurrent limiting circuit suppresses the overcurrent flowing through the output stage transistor 105 according to the degree of the grounding of the output terminal 102. The output stage transistor 105 is a P-channel MOS transistor, and each of transistors M1 through M6 is an N-channel MOS transistor.

In FIG. 8, the transistor M4 through which a current of a constant current source 110 flows and the transistors M1, M2 and M3 construct a current mirror circuit. When the transistor M5 is in an on state, current also flows through the transistor M2, and hence the current flowing through the resistor 113 is the sum of drain currents of the transistors M1 and M2. When the transistors M5 and M6 are respectively in an on state, current also flows through the transistors M2 and M3, and hence the current flowing through the resistor 113 is the sum of drain currents of the transistors M1, M2, and M3. Thus, the current flowing through the resistor 113 is controlled in a multi-stage manner by controlling the transistors M5 and M6.

When the feedback voltage VFB falls below a threshold voltage of the transistor M6 along lowering of the output voltage Vout, the transistor M6 turns off so that no current flows through the transistor M3, and hence the current flowing through the resistor 113 lowers. Further, when the output voltage Vout lowers and falls below the threshold voltage of the transistor M5, the transistor M5 turns off so that no current flows in the transistor M2, and hence the current flowing through the resistor 113 lowers. When the output voltage Vout comes close to zero volt (0V) due to a ground fault or the like, the current flowing through the resistor 113 becomes only the drain current of the transistor M1, and hence the limit voltage V3 rises.

Further, a voltage V2 is controlled to follow the limit voltage V3 to thereby suppress a reduction in the gate voltage V1 of the output stage transistor 105 and hence limit the current of the output stage transistor 105.

SUMMARY OF THE INVENTION

However, since the overcurrent limiting circuit of Japanese Patent Application Laid-Open No. 2009-48362 controls the output current based on the reduction in the output voltage Vout, it is not possible to effectively suppress the generation of heat due to a power loss in the output stage transistor 105 when a power supply voltage VDD is high.

The present invention has been made in view of such circumstances, and aims to provide an overcurrent limiting circuit, an overcurrent limiting method, and a power supply circuit capable of effectively limiting the current flowing through the output stage transistor and suppressing the generation of heat in the output stage transistor when a large current flows through the output stage transistor due to a ground fault or the like even in a case of a high power supply voltage.

There is provided an overcurrent limiting circuit according to one aspect of the present invention which controls to make an output current flowing through an output stage transistor of a power supply circuit not more than a prescribed limit current value. The overcurrent limiting circuit includes a limit voltage generation circuit configured to generate a limit voltage which defines the prescribed limit current value to a current corresponding to a magnitude of a power supply voltage, a source follower having an output terminal and an input terminal connected to a gate of the output stage transistor, and configured to supply from the output terminal a voltage level-shifted from a voltage provided to the input terminal, an error amplifier circuit configured to amplify a difference between the limit voltage and the voltage output from the source follower, and a gate voltage adjustment transistor having a gate to which the voltage supplied from the error amplifier circuit is applied, and configured to control a gate voltage applied to the gate of the output stage transistor.

According to the present invention, there can be provided an overcurrent limiting circuit, an overcurrent limiting method, and a power supply circuit capable of, when large current flows through the output stage transistor due to a ground fault or the like, effectively suppressing the current flowing through the output stage transistor even in a case of a high power supply voltage.

DETAILED DESCRIPTION OF THE PREFERRED EMBODIMENTS

<First Embodiment>

Figure 1:
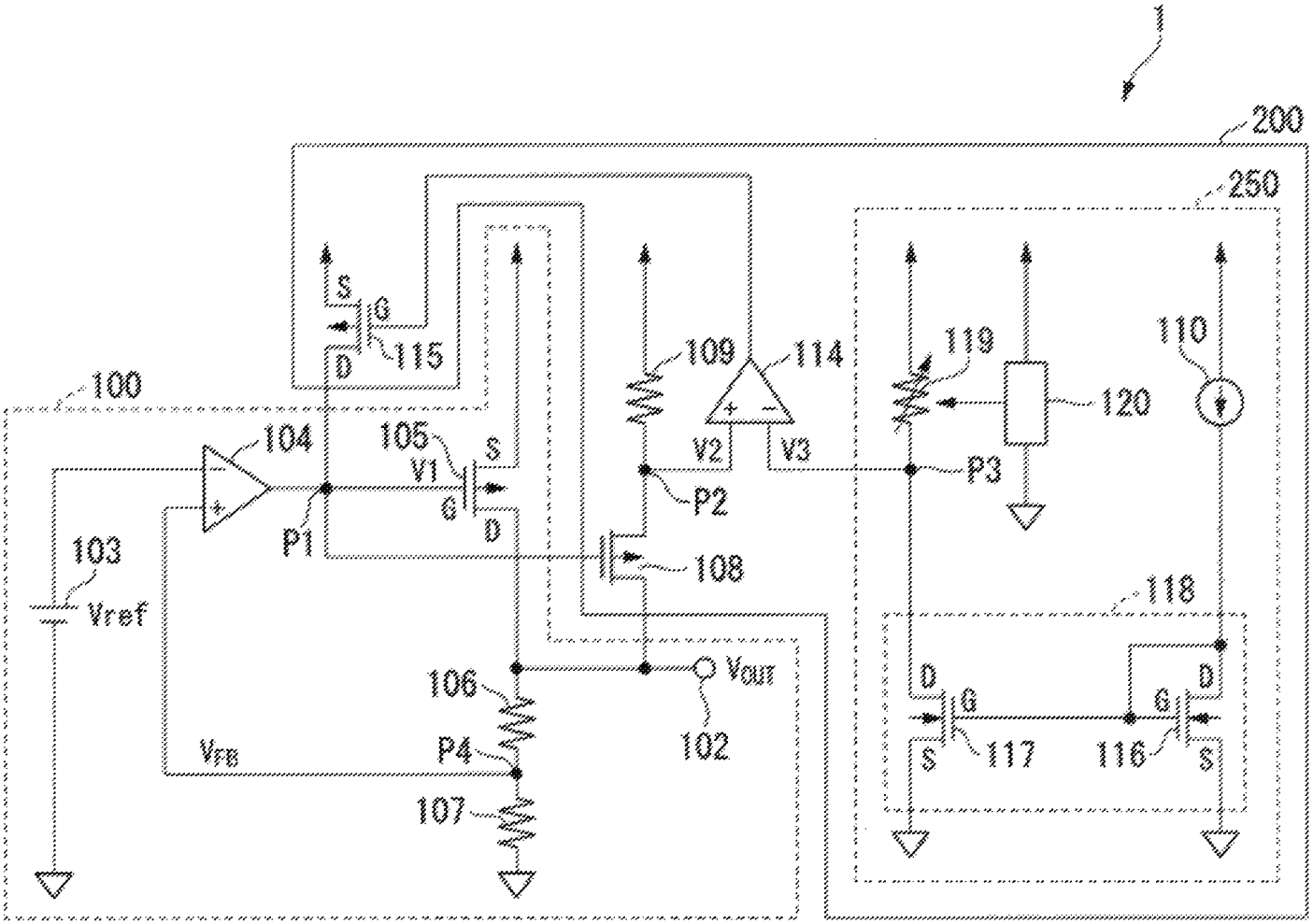
FIG. 1 is a schematic block diagram illustrating a voltage regulator being a power supply circuit using an overcurrent limiting circuit according to the first embodiment of the present invention.

The first embodiment of the present invention will hereinafter be described with reference to the accompanying drawings. FIG. 1 is a schematic block diagram illustrating a voltage regulator which is one of a power supply circuit using an overcurrent limiting circuit according to the first embodiment of the present invention.

In the schematic block diagram, the voltage regulator 1 includes a voltage output circuit 100 and an overcurrent limiting circuit 200.

The voltage output circuit 100 outputs an output voltage Vout having a prescribed voltage set in advance from an output terminal 102. The voltage output circuit 100 has a reference voltage source 103, an error amplifier circuit 104, an output stage transistor 105, and resistors 106, 107.

The overcurrent limiting circuit 200 has a current detection transistor 108, a resistor 109, an error amplifier circuit 114, a gate voltage adjustment transistor 115, and a limit voltage generation circuit 250.

The limit voltage generation circuit 250 generates a limit voltage V3 (which is described later) which limits a current flowing through the output stage transistor 105. The limit voltage generation circuit 250 has a constant current source 110, a current mirror circuit 118, a variable resistor 119, and a limit voltage controller 120.

The current mirror circuit 118 has a transistor 117 and a transistor 116.

The output stage transistor 105 is a P-channel MOS transistor and has a source S connected to a power supply, a gate G connected to an output terminal of the error amplifier circuit 104 through a connecting point P1, and a drain D connected to one end of the resistor 106 and the output terminal 102.

The error amplifier circuit 104 has a minus-side input terminal connected to the ground via the reference voltage source 103, and a plus-side input terminal connected to a connecting point P4.

The resistor 106 has the other end connected to the connecting point P4.

The resistor 107 is connected in series with the resistor 106 and has one end connected to the connecting point P4 and the other end connected to the ground. The voltage of the connecting point P4 is a feedback voltage VFB corresponding to the output voltage Vout and the resistance ratio of the resistor 106 and the resistor 107.

The error amplifier circuit 114 has a plus-side input terminal connected to a connecting point P2, a minus-side input terminal connected to a connecting point P3, and an output terminal connected to a gate G of the gate voltage adjustment transistor 115.

The resistor 109 functions as a current-voltage converter and has one end connected to the power supply and the other end connected to the connecting point P2.

The current detection transistor 108 is a P-channel MOS transistor and has a source S connected to the connecting point P2, a gate G connected to the output terminal of the error amplifier circuit 104, and a drain D connected to the output terminal 102. The current detection transistor 108 and the resistor 109 construct a source follower.

The gate voltage adjustment transistor 115 is a P-channel MOS transistor and has a source S connected to the power supply and a drain D connected to the connecting point P 1.

The variable resistor 119 functions as a current-voltage converter and has one end connected to the power supply, the other end connected to the connecting point P3, and a control terminal connected to an output terminal of the limit voltage controller 120.

The limit voltage controller 120 has an input terminal connected to the power supply and a ground terminal connected to the ground. The limit voltage controller 120 outputs a control signal of a voltage level corresponding to a voltage of the power supply voltage VDD from its output terminal. Here, a high voltage of the power supply voltage VDD causes reduction of the resistance of the variable resistor 119 through the control signal from the limit voltage controller 120.

The transistor 117 is an N-channel MOS transistor and has a drain D connected to the connecting point P3, a source S connected to the ground, and a gate G connected to a gate G of the transistor 116.

The transistor 116 is an N-channel MOS transistor and has a drain D and a gate G respectively connected to the power supply through the constant current source 110, and a source S connected to the ground.

The operation of the voltage regulator which is one of the power supply circuit using the overcurrent limiting circuit according to the first embodiment will hereinafter be described.

The error amplifier circuit 104 amplifies a difference between a reference voltage Vref supplied to the minus-side input terminal and a feedback voltage VFB supplied to the plus-side input terminal and outputs a control signal to the gate G of the output stage transistor 105.

The output stage transistor 105 outputs an output voltage corresponding to the control signal supplied from the error amplifier circuit 104 to the output terminal 102. Thus, the reference voltage Vref and the feedback voltage VFB become equal. As a result, the output voltage Vout is controlled to be constant.

The current detection transistor 108 and the resistor 109 construct a source follower, and generate a voltage V2 obtained by level-shifting a voltage V1 of the connecting point P1.

The error amplifier circuit 114 amplifies a difference between the limit voltage V3 supplied to the minus-side input terminal and the voltage V2 supplied to the plus-side input terminal to output to the gate G of the gate voltage adjustment transistor 115. The limit voltage V3 (which is described later) is generated by the limit voltage generation circuit 250 to limit the current output from the output stage transistor 105 in correspondence with the voltage of the power supply voltage VDD.

The gate voltage adjustment transistor 115 controls the voltage applied to the gate G of each of the output stage transistor 105 and the current detection transistor 108, i.e., the voltage V1 of the connecting point P1 according to a control signal output from the error amplifier circuit 114.

The current detection transistor 108 makes a drain current corresponding to the voltage V1 applied to the gate G to flow through the resistor 109 to generate the voltage V2 at the connecting point P2. The voltage V2 is given by the following equation (1):

$$V2=V1+|VTH108| \quad (1)$$

In the above equation (1), VTH108 is a threshold voltage of the current detection transistor 108.

A description will next be made to the generation of the limit voltage V3 by the limit voltage generation circuit 250.

A current flowing through the constant current source 110 defines a current flowing into the variable resistor 119 through the current mirror circuit 118. Assume now that the transistor 116 and the transistor 117 have the same aspect ratio, i.e., a drain current of the transistor 117 and a drain current of the transistor 116 are equal.

Since the variable resistor 119 functions as a current-voltage converter, the drain current I117 flowing through the transistor 117 is converted into the limit voltage V3 by the voltage drop due to a resistance R119 of the variable resistor 119. The limit voltage V3 is given by the following equation (2):

$$V3=VDD-R119\times I117 \quad (2)$$

As described above, the error amplifier circuit 114 compares the voltage V2 and the limit voltage V3. When the voltage V2 is less than the limit voltage V3, the error amplifier circuit 114 lowers the voltage of the gate G of the gate voltage adjustment transistor 115.

The drain current of the gate voltage adjustment transistor 115 hence increases so that the voltage of the connecting point P1 rises. Thus, the current flowing through the output stage transistor 105 is reduced to limit an overcurrent.

Here, in a negative feedback circuit including the error amplifier circuit 114, the voltage V2 and the limit voltage V3 both provided to the error amplifier circuit 114 is the same (V2=V3) in an overcurrent limiting state. Accordingly, the voltage V1 is given by the following equation (3) from the equations (1) and (2):

$$V1=VDD-R119\times I117-|VTH108| \quad (3)$$

Further, when the drain current (saturation drain current) flowing through the output stage transistor 105 is denoted by I115, the drain current I115 is given by the following equation (4):

$$I115=K105\times(VDD-V1-|VTH105|)^2 \quad (4)$$

In the above equation (4), VTH105 is a threshold voltage of the output stage transistor 105. K105 is a transconductance coefficient of the output stage transistor 105 and is given by the following equation (4'):

$$K105=(1/2)\times\mu105\times Cox105\times(W105/L105) \quad (4')$$

In the above equation (4'), μ105 is mobility of carriers (positive holes) in the output stage transistor 105. Cox105 is a gate oxide film capacitance per unit area of the gate G of the output stage transistor 105. W105 is the width of a channel region of the output stage transistor 105. L105 is the length (channel length) of the channel region of the output stage transistor 105. Thus, W105/L105 indicates the aspect ratio of the gate G of the output stage transistor 105.

The above equation (3) is substituted into the above equation (4), and the value of the drain current of the output stage transistor 105 at this time is assumed to be an output current limit value ILIM1. Further, substituting the equation (3) into the equation (4) where the output stage transistor 105 and the current detection transistor 108 are similar in transistor characteristic and the same in threshold voltage, i.e., VTH105=VTH108 yields an equation (5) given below:

$$ILIM1=K105\times(R119\times I117)^2 \quad (5)$$

It is understood from the above equation (5) that the output current limit value ILIM1 flowing through the output stage transistor 105 can be reduced by lessening the resistance of the variable resistor 119 or reducing the drain current flowing through the transistor 117 in case of rising of the power supply voltage VDD.

That is, according to the present embodiment, since the limit voltage controller 120 reduces the resistance of the variable resistor 119 according to the increase in the voltage of the power supply voltage VDD, the current supplied from the output stage transistor 105 can be limited to the output current limit value ILIM1 or less corresponding to the voltage of the power supply voltage VDD by increasing the voltage of the limit voltage V3 at the connecting point P3 in correspondence with the power supply voltage VDD, thus making it possible to effectively suppress heat generation in the output stage transistor 105 as compared with the related art example.

That is, according to the present embodiment, even when the power supply voltage is high, it is possible to effectively suppress power loss by heat generation in the output stage transistor 105 when a large current flows in the output stage transistor 105 due to a ground fault or the like.

Figure 2:
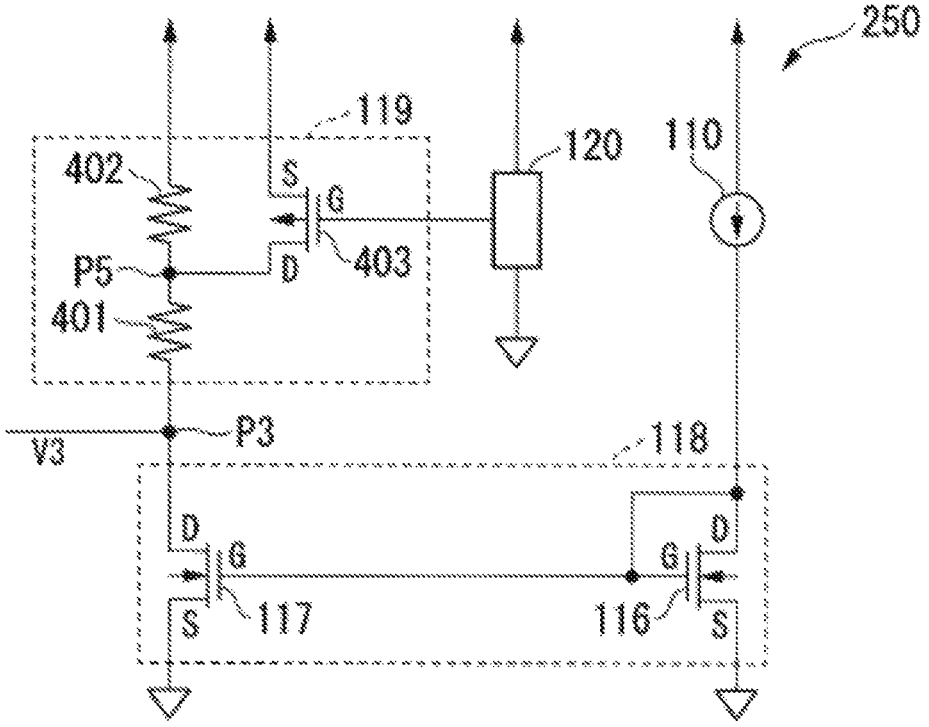
FIG. 2 is a circuit diagram illustrating a specific example of a variable resistor in the overcurrent limiting circuit according to the first embodiment of the present invention.

FIG. 2 is a circuit diagram illustrating a specific example of the variable resistor 119 in the overcurrent limiting circuit according to the present embodiment.

A variable resistance circuit 119 illustrated in FIG. 2 has a resistor 401, a resistor 402, and a transistor 403.

The resistor R401 and the resistor 402 are connected and inserted in series between the power supply and the connecting point P3. The transistor 403 is a P-channel MOS transistor and has a source S connected to the power supply, a drain D connected to a connecting point P5, and a gate G connected to the output terminal of the limit voltage controller 120. The transistor 403 is a transistor for resistance adjustment in the variable resistance circuit 119.

According to the variable resistance circuit 119 constructed as described above, when the power supply voltage VDD is higher than a prescribed value, the transistor 403 enters an on state by a control signal of the limit voltage controller 120, and the resistance R119 lowers. Thus, it is understood that the voltage V2 at the connecting point P2 can be raised, and the output current limit value ILIM1 flowing through the output stage transistor 105 can be reduced.

<Second Embodiment>

Figure 3:
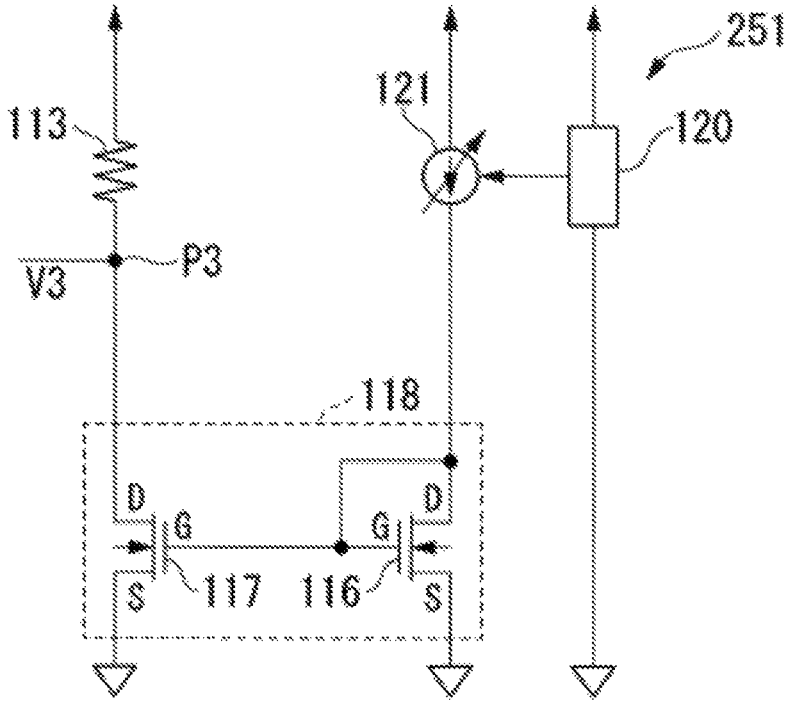
FIG. 3 is a schematic block diagram illustrating a limit voltage generation circuit in an overcurrent limiting circuit according to the second embodiment of the present invention.

A second embodiment of the present invention will hereinafter be described with reference to the accompanying drawings. FIG. 3 is a schematic block diagram illustrating a limit voltage generation circuit in an overcurrent limiting circuit according to the second embodiment of the present invention.

The second embodiment includes a limit voltage generation circuit 251 instead of the limit voltage generation circuit 250 illustrated in FIG. 1. In other part of the configuration the second embodiment is similar to the first embodiment illustrated in FIG. 1.

The limit voltage generation circuit 251 includes a variable constant current source 121, a current mirror circuit 118, a resistor 113 being a current-voltage converter, and a limit voltage controller 120.

The variable constant current source 121 has one end connected to a power supply, the other end connected to a gate G and a drain D of a transistor 116 in the current mirror circuit 118, and a control terminal connected to an output terminal of the limit voltage controller 120 and makes a current flow corresponding to the voltage supplied to the control terminal A description will next be made to the generation of a limit voltage V3 in the limit voltage generation circuit 251.

Since the voltage drop due to the resistor 113 is R113×I117 when the resistance of the resistor 113 is assumed to be R113, the limit voltage V3 is given by the following equation (6):

$$V3=VDD-R113\times I117 \quad (6)$$

Further, when the drain current of an output stage transistor 105 is assumed to be an output current limit value ILIM2 in association with the equation (5) in the first embodiment, the output current limit value ILIM2 is given by the following equation (7):

$$ILIM2=K105\times\{R113\times I117\}^2 \quad (7)$$

With the above configuration, in response to the increase of the voltage of the power supply voltage VDD, the current flowing through the variable constant current source 121 reduces, and the voltage drop due to the resistor 113 decreases to thereby raise the limit voltage V3. Thus, a voltage V2 at a connecting point P2 can be raised, and hence the output current limit value ILIM2 flowing through the output stage transistor 105 can be reduced.

Figure 4:
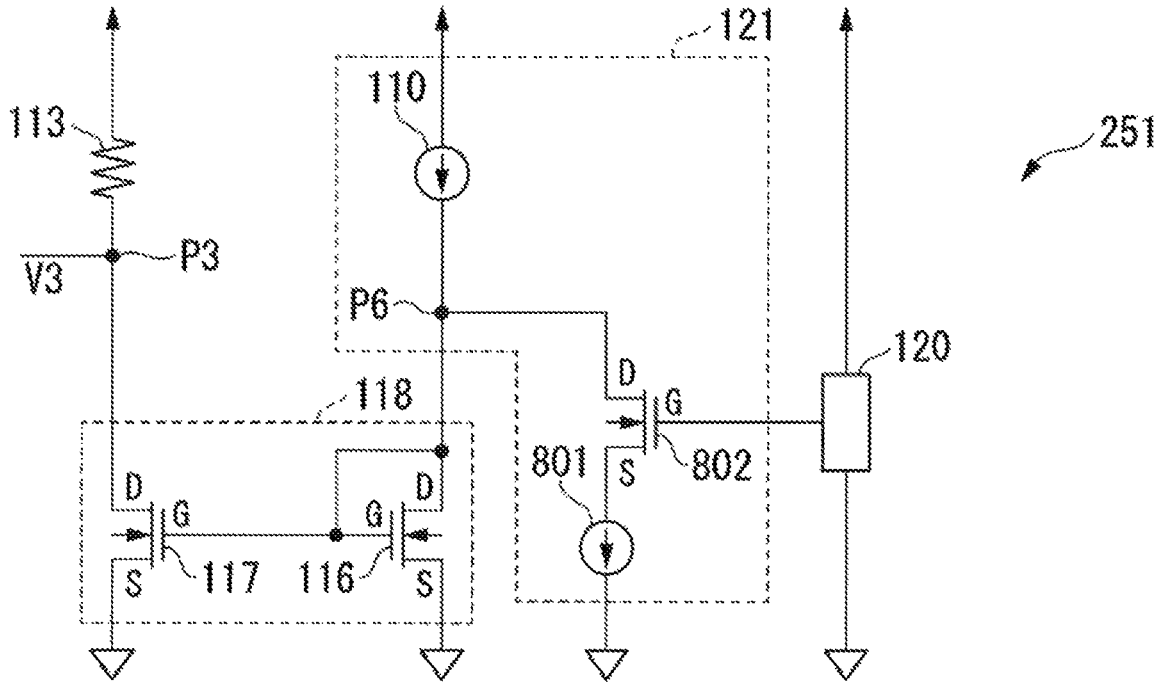
FIG. 4 is a circuit diagram illustrating a specific example of a variable constant current source in the overcurrent limiting circuit according to the second embodiment of the present invention.

FIG. 4 is a circuit diagram illustrating a specific example of the variable constant current source 121 in the overcurrent limiting circuit according to the present embodiment.

The variable current source 121 includes constant current sources 110 and 801, and a transistor 802.

The transistor 802 is an N-channel MOS transistor and has a drain D connected to a connecting point P6, a source S connected to the ground via the constant current source 801, and a gate G connected to the output terminal of the limit voltage controller 120.

According to the variable constant current source 121 constructed as described above, in response to the increase of the voltage of the power supply voltage VDD, the current flowing through the constant current source 801 increases to thereby enable reduction of the current flowing through the resistor 113, thus making it possible to raise the limit voltage V3. Accordingly, it is understood that the voltage V2 at the connecting point P2 can be raised and hence the output current limit value ILIM2 flowing through the output stage transistor 105 can be reduced.

<First Configurational Example of Limit Voltage Controller>

Figure 5:
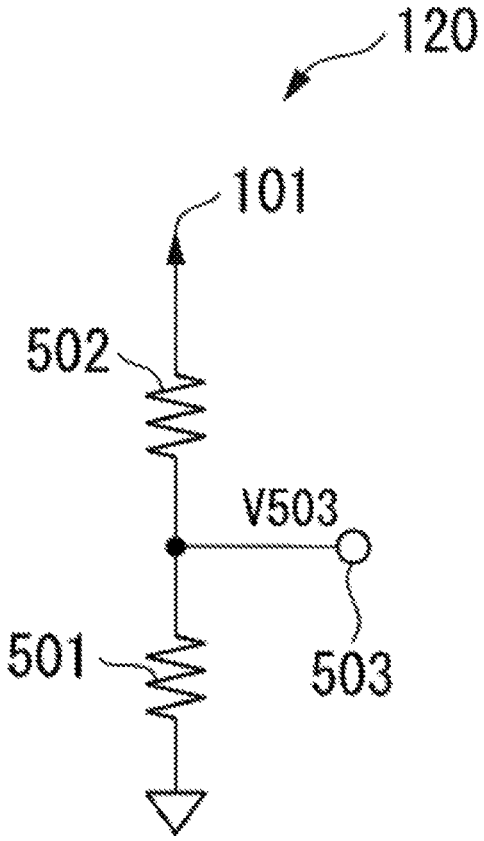
FIG. 5 is a circuit diagram illustrating a specific example of a limit voltage controller in the first and second embodiments.

FIG. 5 is a circuit diagram illustrating a specific example of the limit voltage controller 120. The limit voltage controller illustrated in FIG. 5 can be used in the first and second embodiments described above.

The limit voltage controller 120 illustrated in FIG. 5 has a resistor 502 and a resistor 501 connected in series, and an output terminal 503.

A voltage V503 of the output terminal 503 is determined according to a resistance ratio between the resistor 502 and the resistor 501. A voltage divided based on the resistance ratio is provided from the output terminal of the limit voltage controller 120 as a control signal.

When the power supply voltage VDD rises, the limit voltage controller 120 constructed as illustrated in FIG. 5 reduces the voltage of the gate G of the transistor 403 relative to its source S in the circuit example of FIG. 2, and raises the voltage of the gate G of the transistor 802 relative to its source S in the circuit example of FIG. 4. That is, the limit voltage controller 120 in FIG. 5 is capable of controlling the variable resistor 119 and the variable constant current source 121 as described in the respective embodiments.

<Second Configurational Example of Limit Voltage Controller>

Figure 6A:
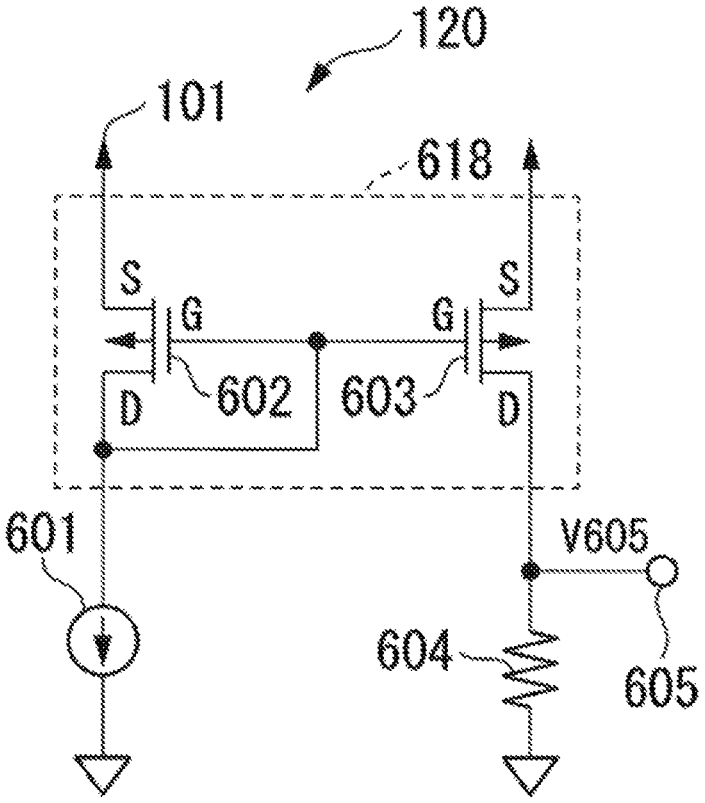
FIG. 6A is a circuit diagram illustrating a specific example of the limit voltage controller in the first embodiment.

FIG. 6A is a circuit diagram illustrating a specific example of the limit voltage controller 120. That is, FIG. 6A is a diagram describing a configurational example of the limit voltage controller. The limit voltage controller illustrated in FIG. 6A can be used in the first embodiment described above.

The limit voltage controller 120 illustrated in FIG. 6A includes a current mirror circuit 618, a current source 601, and a resistor 604. The current mirror circuit 618 has a transistor 602 and a transistor 603.

The transistor 602 is a P-channel MOS transistor and has a source S connected to the power supply, and a gate G and a drain D connected to the ground via the current source 601.

The transistor 603 is a P-channel MOS transistor and has a source S connected to the power supply, a gate G connected to the gate G of the transistor 602, and a drain D connected to one end of the resistor 604.

The resistor 604 has one end connected to an output terminal 605 and the other end connected to the ground.

In the current mirror circuit 618, a current supplied by the current source 601 is mirrored to a drain current of the transistor 603 in accordance with a prescribed mirror ratio which flows through the resistor 604.

Thus, a voltage V605 due to a voltage drop in the resistor 604 is supplied from the output terminal 605 according to the drain current flowing through the transistor 603.

A correspondence between the power supply voltage VDD of the limit voltage controller 120 and the voltage V605 will hereinafter be described with reference to the drawings.

Figure 6B:
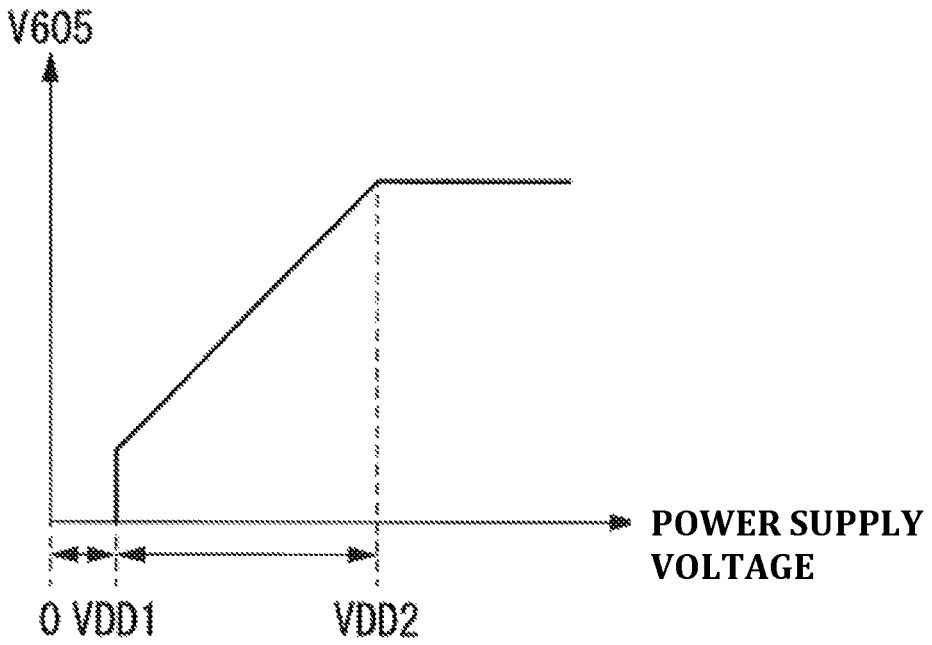
FIG. 6B illustrates the correspondence between the power supply voltage VDD of the limit voltage controller 120 and the voltage V905.

FIG. 6B illustrates the correspondence between the power supply voltage VDD of the limit voltage controller 120 and the voltage V605. The horizontal axis indicates the voltage (V) of the power supply voltage VDD, and the vertical axis indicates the voltage (V) of the voltage V605.

Since the transistor 603 is in an off state when the voltage of the power supply voltage VDD ranges from 0V to less than VDD1, no current flows through the resistor 604 and the voltage V605 is 0V.

The transistor 603 enters an on state at VDD1 of the voltage of the power supply voltage VDD and operates in a resistance region (linear region) from VDD1 to VDD2 of the power supply voltage VDD. In the resistance region, the voltage V605 linearly increases as the current flowing through the transistor 603 increases. The voltage V605 is nearly equal to the power supply voltage VDD (a relation V605≈VDD holds) in the resistance region.

Thus, since the voltage V605 is applied to the gate U of the transistor 403 when the circuit illustrated in FIG. 6A is used in the limit voltage controller 120 in the circuit of FIG.

2, the voltage (VDD−V605) is lower than a threshold voltage |VTH403| of the transistor 403 until the power supply voltage VDD is up to VDD2, so that the transistor 403 enters an off state.

Further, when the power supply voltage VDD exceeds VDD2, the voltage V605 is held constant since the transistor 603 enters a saturation region so that the drain current of the transistor 603 becomes almost constant without increase. That is, when the power supply voltage VDD exceeds VDD2, VDD and V605 satisfy a relation VDD>V605. When a relation VDD−V605>|VTH403| holds, the transistor 403 enters an on state.

As a result, the resistance of the variable resistance circuit 119 changes to raise the voltage of the limit voltage V3, thereby enabling reduction of the output current limit value ILIM1.

Further, the resistor 604 in FIG. 6A may be replaced with another current-voltage converting element. For example, one or plural diode-connected transistors connected in series in a multi-stage manner in which gate G and drain D of each of the transistors are connected may be inserted in the configuration. Also, in place of the resistor 604, a diode may be inserted in a forward direction between the output terminal 605 and the ground in the configuration.

<Third Configurational Example of Limit Voltage Controller>

Figure 7A:
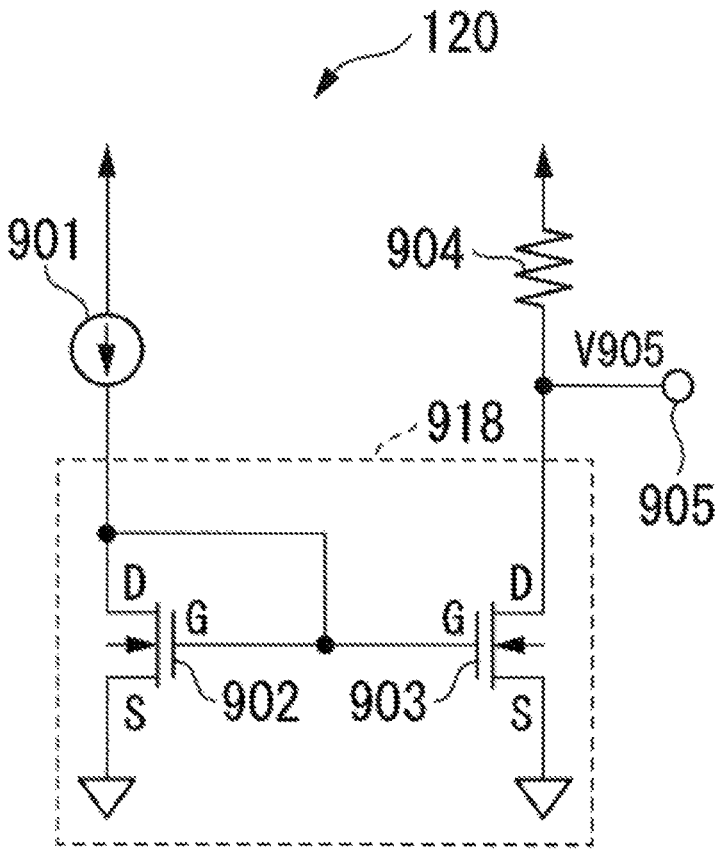
FIG. 7A is a circuit diagram illustrating a specific example of the limit voltage controller in the second embodiment.

FIG. 7A is a circuit diagram illustrating a specific example of the limit voltage controller 120. That is, FIG. 7A is a diagram describing a configurational example of the limit voltage controller. The limit voltage controller illustrated in FIG. 7A can be used in the second embodiment described above.

The limit voltage controller 120 illustrated in FIG. 7A includes a current mirror circuit 918, a current source 901, and a resistor 904. The current mirror circuit 918 has a transistor 902 and a transistor 903.

The transistor 902 is an N-channel MOS transistor and has a drain D and a gate G connected to the power supply through the current source 901, and a source S connected to the ground.

The transistor 903 is an N-channel MOS transistor and has a drain D connected to an output terminal 905, a gate G connected to the gate G of the transistor 902, and a source S connected to the ground.

The resistor 904 has one end connected to the power supply and the other end connected to the output terminal 905.

In the current mirror circuit 918, a current supplied by the current source 901 is mirrored to a drain current of the transistor 903 in accordance with a prescribed mirror ratio which flows through the resistor 904.

Thus, a voltage V905 due to a voltage drop in the resistor 904 is supplied from the output terminal 905 according to the drain current flowing through the transistor 903.

A correspondence between the power supply voltage VDD of the limit voltage controller 120 and the voltage V905 will hereinafter be described with reference to the drawings.

Figure 7B:
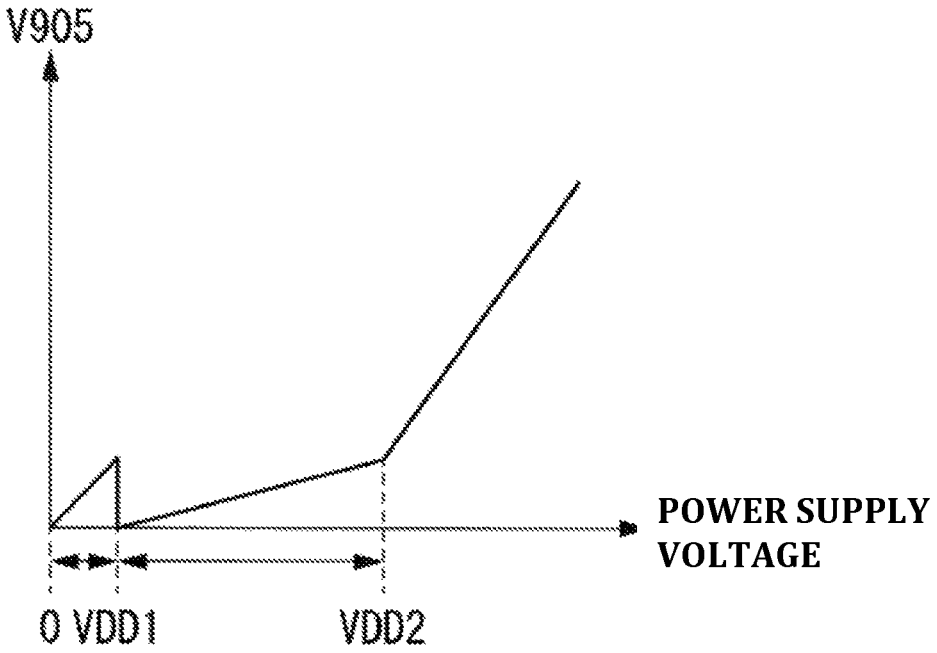
FIG. 7B illustrates the correspondence between the power supply voltage VDD of limit voltage controller 120 and the V905.
Figure 8:
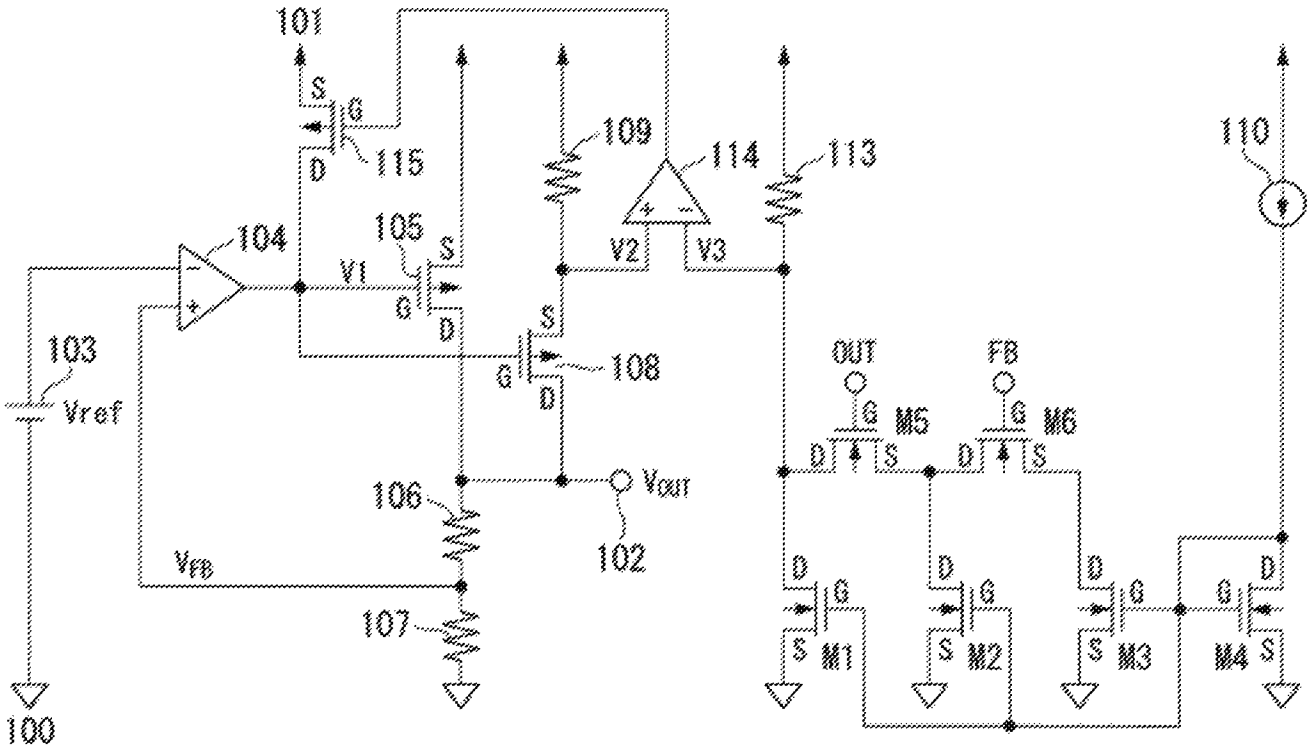
FIG. 8 is a schematic block diagram of a voltage regulator for describing a overcurrent limiting circuit of related art.

FIG. 7B illustrates the correspondence between the power supply voltage VDD of the limit voltage controller 120 and the voltage V905. The horizontal axis indicates the voltage (V) of the power supply voltage VDD, and the vertical axis indicates the voltage (V) of the voltage V905.

Since the transistor 903 is in an off state when the voltage of the power supply voltage VDD ranges from 0V to just before VDD1, the voltage V905 gradually rises according to an increase in the power supply voltage VDD.

When the voltage of the power supply voltage VDD exceeds VDD1, the transistor 903 enters an on state. Thereby, after the voltage V905 once retunes to 0V, the transistor 903 operates in a resistance region (linear region) from VDD1 to VDD2 of the power supply voltage VDD so that the voltage V905 gradually increases with the power supply voltage VDD.

Further, since the transistor 903 enters a saturation region when the power supply voltage VDD exceeds VDD2, the voltage V905 rises with a gradient in which the increase in the voltage V905 and the increase in the power supply voltage VDD are the same.

That is, regarding the operation of the transistor 903 in the saturation region, the drain current of the transistor 903 is denoted by I903, and the resistance of the resistor 904 is denoted by R904, then the voltage V905 is given by VDD−R904×I903.

Since V905 is applied to the gate G of the transistor 802 when the circuit illustrated in FIG. 7A is used as the limit voltage controller 120 in the circuit of FIG. 2, a relation VDD−R904×I903>|VTH802| is not established until the power supply voltage VDD exceeds VDD2 and the transistor 903 enters the saturation region, and hence the transistor 802 is kept in an off state.

Further, when the power supply voltage VDD exceeds VDD2, and the transistor 903 enters the saturation region, the voltage V905 also rises in response to an increase in the power supply voltage VDD. That is, a relation VDD>R904×I903 is satisfied by the exceedance of the power supply voltage VDD over VDD2. When the relation FVDD−R904×I903>|VTH802| holds, the transistor 802 enters an on state.

As a result, the value of the current flowing through the transistor 117 reduces to raise the voltage of the limit voltage V3, so that the output current limit value ILIM2 can be lowered.

Further, the resistor 904 in FIG. 7A may be replaced with another current-voltage converting element. For configurational example, one or plural diode-connected transistors in which gate G and drain D of each of the transistors are connected may be connected in series, also a diode may be inserted in a forward direction between the power supply and the output terminal 905.

Furthermore, although the first through fourth embodiments have respectively described as an example, the step-down voltage regulator 1 as the power supply circuit, in which the feedback voltage VFB obtained by dividing the output voltage Vout with the division resistors, and the reference voltage Vref are controlled to be equal, the embodiments may be used for a configuration of limiting an overcurrent in the output stage transistor at the output stage of the power supply such as the voltage regulator in which the output voltage Vout is controlled to be equal to the reference voltage Vref.

Although the embodiments of the present invention have been described above in detail with reference to the drawings, specific configurations are not limited to those in the embodiments and also include design or the like in the scope not departing from the spirit of the present invention. Although the limit voltage generation circuit 250 is constructed to copy the current of the constant current source 110 by the current mirror circuit 118 to have the same current flowing through the variable resistor 119 in FIG. 1, for example, the limit voltage generation circuit 250 may not be constructed to copy the current by the current mirror circuit 118. Further, although the variable resistor 119 is constructed to include the resistors 401 and 402 connected in series, it may be constructed to have parallel resistors. In that case, the limit voltage controller 120 suitable for its configuration may be adopted. Besides, the same also applies to the variable constant current source 121.

What is claimed is:

1. An overcurrent limiting circuit controlling to make an output current flowing through an output stage transistor of a power supply circuit not more than a prescribed limit current value, comprising:

a limit voltage generation circuit configured to generate a limit voltage which defines the prescribed limit current value as a current corresponding to a magnitude of a power supply voltage;

a source follower having an output terminal and an input terminal which is connected to a gate of the output stage transistor, and configured to supply from the output terminal a voltage level-shifted from a voltage provided to the input terminal;

an error amplifier circuit configured to amplify a difference between the limit voltage and the voltage supplied from the output terminal of the source follower; and a gate voltage adjustment transistor having a gate to which a voltage supplied from the error amplifier circuit is applied, and configured to control a gate voltage applied to the gate of the output stage transistor;

wherein the limit voltage generation circuit comprises:

a variable resistor;

a constant current circuit configured to make a prescribed current flow into the variable resistor; and a limit voltage controller configured to detect a voltage of the power supply voltage and generate a control signal corresponding to the voltage of the power supply voltage, and wherein the control signal changes a resistance of the variable resistor, and the limit voltage is supplied based on a voltage generated in the variable resistor.

2. The overcurrent limiting circuit according to claim 1, wherein the limit voltage generation circuit generates the limit voltage reducing the prescribed limit current value in response to an increase in the power supply voltage.

3. A power supply circuit comprising:

a second error amplifier circuit configured to amplify a difference between a reference voltage and a voltage corresponding to an output voltage generated from a power supply voltage supplied from a power supply;

an output stage transistor configured to output the output voltage corresponding to the reference voltage, according to an output signal supplied from the second error amplifier circuit to a gate thereof; and the overcurrent limiting circuit according to claim 2.

4. A power supply circuit comprising: a second error amplifier circuit configured to amplify a difference between a reference voltage and a voltage corresponding to an output voltage generated from the power supply voltage supplied from the power supply circuit; an output stage transistor configured to output the output voltage corresponding to the reference voltage, according to an output signal supplied from the second error amplifier circuit to a gate thereof; and the overcurrent limiting circuit according to claim 1.

5. An overcurrent limiting circuit controlling to make an output current flowing through an output stage transistor of a power supply circuit not more than a prescribed limit current value, comprising:

a limit voltage generation circuit configured to generate a limit voltage which defines the prescribed limit current value as a current corresponding to a magnitude of a power supply voltage;

a source follower having an output terminal and an input terminal which is connected to a gate of the output stage transistor, and configured to supply from the output terminal a voltage level-shifted from a voltage provided to the input terminal;

an error amplifier circuit configured to amplify a difference between the limit voltage and the voltage supplied from the output terminal of the source follower; and a gate voltage adjustment transistor having a gate to which a voltage supplied from the error amplifier circuit is applied, and configured to control a gate voltage applied to the gate of the output stage transistor;

wherein the limit voltage generation circuit comprises:

a current-voltage converter;

a variable constant current circuit configured to make a current flow in the current-voltage converter; and a limit voltage controller configured to detect a voltage of the power supply voltage and generate a control signal corresponding to the voltage of the power supply voltage, and wherein the control signal changes a current of the variable constant current circuit, and the limit voltage is supplied based on a voltage generated in the current-voltage converter.

6. A power supply circuit comprising:

a second error amplifier circuit configured to amplify a difference between a reference voltage and a voltage corresponding to an output voltage generated from a power supply voltage supplied from a power supply;

an output stage transistor configured to output the output voltage corresponding to the reference voltage, according to an output signal supplied from the second error amplifier circuit to a gate thereof; and the overcurrent limiting circuit according to claim 5.

7. The overcurrent limiting circuit according to claim 5, wherein the limit voltage generation circuit generates the limit voltage reducing the limit current value in response to an increase in the power supply voltage.

8. A power supply circuit comprising: a second error amplifier circuit configured to amplify a difference between a reference voltage and a voltage corresponding to an output voltage generated from the power supply voltage supplied from the power supply circuit; an output stage transistor configured to output the output voltage corresponding to the reference voltage, according to an output signal supplied from the error amplifier circuit to a gate thereof, and the overcurrent limiting circuit according to claim 7.

9. A power supply circuit comprising: a second error amplifier circuit configured to amplify a difference between a reference voltage and a voltage corresponding to an output voltage generated from the power supply voltage supplied from the power supply circuit; an output stage transistor configured to output the output voltage corresponding to the reference voltage, according to an output signal supplied from the error amplifier circuit to a gate thereof; and the overcurrent limiting circuit according to claim 5.

10. An overcurrent limiting method of controlling to make an output current flowing through an output stage transistor of a power supply circuit not more than a prescribed limit current value, comprising:

generating a limit voltage which defines the prescribed limit current value as a current corresponding to a magnitude of a power supply voltage;

supplying, from an output terminal of a source follower, a voltage level-shifted from a voltage provided to an input terminal of the source follower which is connected to a gate of the output stage transistor;

amplifying a difference between the limit voltage and the voltage supplied from the output terminal of the source follower by an error amplifier circuit; and controlling a gate voltage applied to the gate of the output stage transistor by a gate voltage adjustment transistor having a gate applied with a voltage output from the error amplifier circuit;

wherein generating the limit voltage further comprises:

making, by a constant current circuit, a prescribed current flow into a variable resistor;

detecting, by a limit voltage controller, a voltage of the power supply voltage;

generating, by the limit voltage controller, a control signal corresponding to the power supply voltage;

changing a resistance of the variable resistor based on the control signal; and supplying the limit voltage based on a voltage generated in the variable resistor.

11. An overcurrent limiting method of controlling to make an output current flowing through an output stage transistor of a power supply circuit not more than a prescribed limit current value, comprising:

generating a limit voltage which defines the prescribed limit current value as a current corresponding to a magnitude of a power supply voltage;

supplying, from an output terminal of a source follower, a voltage level-shifted from a voltage provided to an input terminal of the source follower which is connected to a gate of the output stage transistor;

amplifying a difference between the limit voltage and the voltage supplied from the output terminal of the source follower by an error amplifier circuit; and controlling a gate voltage applied to the gate of the output stage transistor by a gate voltage adjustment transistor having a gate applied with a voltage output from the error amplifier circuit;

wherein generating the limit voltage further comprises:

making, by a variable constant current circuit, a current flow in a current-voltage converter;

detecting, by a limit voltage controller, a voltage of the power supply voltage;

generating, by the limit voltage controller, a control signal corresponding to the power supply voltage;

changing a current of the variable constant current circuit based on the control signal; and supplying the limit voltage based on a voltage generated in the current-voltage converter.

* * * * *